US005420611A

United States Patent [19]

Sarraf

[11] Patent Number: 5,420,611

[45] Date of Patent: May 30, 1995

[54] APPARATUS AND METHOD FOR ELIMINATING FEEDBACK NOISE IN LASER THERMAL PRINTING

[75] Inventor: Sanwal P. Sarraf, Webster, N.Y.

[73] Assignee: Eastman Kodak Company, Rochester, N.Y.

[21] Appl. No.: 905,948

[22] Filed: Jun. 29, 1992

[51] Int. Cl.[6] ..... B41J 2/48; B41J 2/325

[52] U.S. Cl. ..... 342/264; 503/227; 347/215

[58] Field of Search ..... 346/1.1, 76 PH, 76 L, 346/108; 430/200, 201, 202, 945; 503/227

[56] References Cited

U.S. PATENT DOCUMENTS

| | | | |
|---|---|---|---|
| 3,904,981 | 9/1975 | Hughes et al. | 331/94.5 K |
| 4,003,631 | 1/1977 | Biet et al. | 350/160 R |
| 4,005,259 | 1/1977 | Kaneko | 358/128 |
| 4,250,465 | 2/1981 | Leib | 331/94.5 D |
| 5,017,547 | 5/1991 | DeBoer | 503/227 |
| 5,066,962 | 11/1991 | Sarraf | 346/76 L |
| 5,105,206 | 4/1992 | Sarraf et al. | 346/76 L |
| 5,164,742 | 11/1992 | Baek et al. | 346/76 L |
| 5,168,288 | 12/1992 | Baek et al. | 346/76 L |
| 5,244,770 | 9/1993 | DeBoer et al. | 430/200 |
| 5,291,218 | 3/1994 | DeBoer | 346/76 PH |

*Primary Examiner*—Huan H. Tran
*Attorney, Agent, or Firm*—Dennis R. Arndt

[57] ABSTRACT

An apparatus and method are provided for forming a laser-induced thermal dye transfer image. A slide for brings a dye donor and dye receiver into dye transferring proximity, and a laser emits a beam of light toward the donor to image-wise transfer dye to the receiver. The slide, along with the donor therein, is tilted to eliminate intensity noise in the laser caused by light reflecting from the slide and donor back to the laser. By tilting the slide, specular reflections from the dye donor do not intercept optical path and do not propagate along the optical path.

12 Claims, 1 Drawing Sheet

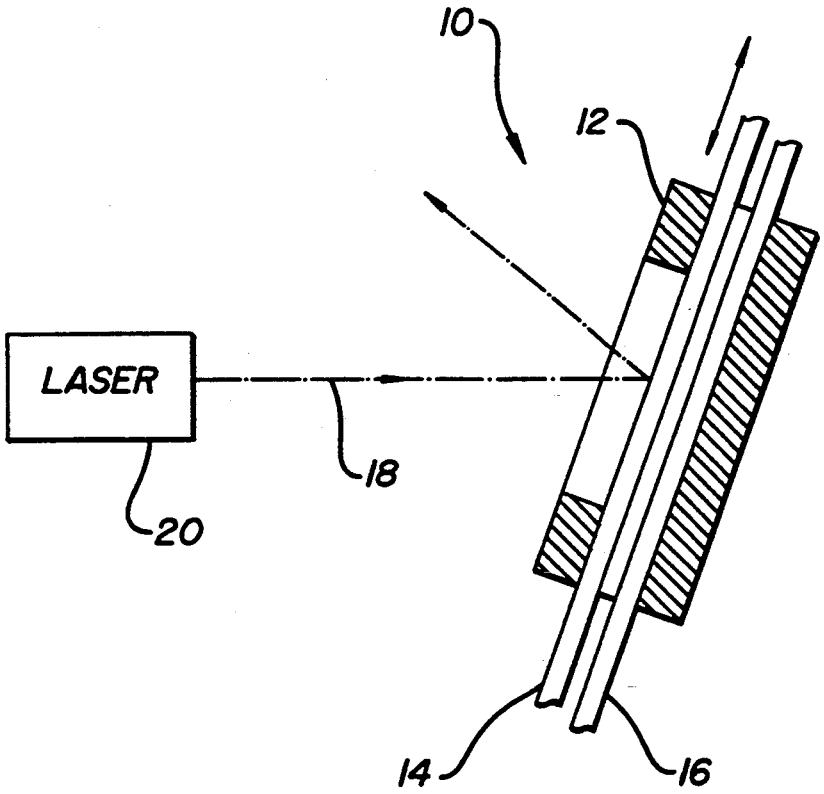
10
12
LASER
18
20
14
16

APPARATUS AND METHOD FOR ELIMINATING FEEDBACK NOISE IN LASER THERMAL PRINTING

TECHNICAL FIELD OF THE INVENTION

The present invention relates generally to laser thermal printing, and, more particularly, to an apparatus and method for eliminating artifacts caused by feedback noise created by light reflected along the optical path from the donor and optical components to the laser.

BACKGROUND OF THE INVENTION

Laser feedback noise is a concern in laser printing systems and other systems, such as optical disks, for example, because it affects print quality by causing artifacts. Accordingly, it will be appreciated that it would be highly desirable to eliminate artifacts in laser thermal images caused by the intensity noise of the laser due to reflected light feeding back to the laser cavity.

A variety of methods are used to eliminate the noise, or, at the very least, significantly reduce the noise. One way is to exploit the polarization characteristics of diode lasers. More than 90 percent of the radiation emitted by a diode laser is linearly polarized and passes through a half-wave plate where it rotates by 90°. The rotated beam is transmitted by a beam polarizer to a quarter-wave plate which has a crystalline axis oriented at 45° from the plane of polarization. The quarter-wave plate converts the linearly polarized light into circularly polarized light. The specular reflections are also circularly polarized but with opposite direction, and are extinguished upon their return to the polarizer. While wave plates and polarizers are effective, they are also expensive, difficult to align and diminish the effective power of the laser. Any lost power adversely effects the printing speed which is undesirable. Accordingly, it will be appreciated that it would be highly desirable to eliminate intensity noise of the laser without employing expensive components or components difficult to align. It is also desirable to eliminate intensity noise without sacrificing the available power of the laser.

SUMMARY OF INVENTION

The present invention is directed to overcoming one or more of the problems set forth above. Briefly summarized, according to one aspect of the invention, a method for forming a laser-induced thermal dye transfer image comprises bringing a dye donor into dye transferring proximity to a receiver, heating the donor by a laser, transferring dye from the donor to the receiver and forming a laser-induced thermal dye transfer image, and tilting the donor and eliminating intensity noise in the laser caused by light reflecting from the donor back to the laser.

The donor is tilted at an angle to the incoming beam so that the beam is deflected away from the donor in a direction not coincident with the incoming beam without a loss of laser power.

According to another aspect of the invention, an apparatus for forming a laser-induced thermal dye transfer image comprises a slide for bringing a dye donor element into dye transferring proximity to a dye receiver element with the dye donor receiving light projected along an optical path. The slide, along with the donor therein, is tilted to eliminate intensity noise in the laser caused by light reflecting from the slide and donor back to the laser. By tilting the slide, specular reflections from the dye donor do not intercept optical path and do not propagate along the optical path.

These and other aspects, objects, features and advantages of the present invention will be more clearly understood and appreciated from a review of the following detailed description of the preferred embodiments and appended claims, and by reference to the accompanying drawing.

BRIEF DESCRIPTION OF THE DRAWING

The drawing is a diagram of a preferred embodiment of laser thermal printing apparatus with the dye donor tilted in accordance with the present invention.

DETAILED DESCRIPTION OF THE PREFERRED EMBODIMENTS

Referring to the drawing, a laser imaging apparatus 10 is illustrated for forming a laser-induced thermal dye transfer image. The apparatus includes a slide 12 for bringing a dye donor element 14 into dye transferring proximity to a dye receiver element 16. The dye donor 14 comprises a support having a dye layer thereon and an infrared-absorbing material. The dye receiver element 16 comprises a support having a polymeric dye image-receiving layer thereon.

The slide 12 preferably has two openings. One opening receives the donor 14, and the other opening admits a beam of light 18 to scan the donor 14. The slide 12 holds the donor 14 in close proximity to the receiver 16, but maintains a gap therebetween to physically separate the donor 14 and receiver 16. The slide 12, which acts as a film holder, may be mounted on a translation stage or may be part of a translation stage so that the donor-receiver pair can be scanned across the laser beam 18 in one direction. Physical separation improves print quality by preventing the donor 14 from sticking to the receiver 16. Physical separation may be achieved, for example, by spacer beads which are well known in the art as indicated in U.S. Pat. No. 5,017,547.

The slide 12 brings the dye donor element 14 into dye transferring proximity to the dye receiver element 16 so that the donor 14 receives the beam of light 18 projected along the optical path. The slide 14 is tilted at an angle with respect to the incoming .beam 18 to eliminate intensity noise caused by light reflecting from the dye donor 14 along the optical path. The slide 12 is movable, relative to the beam 18, while so tilted to scan the donor 14 across the beam 18 in a page scan direction as indicated by the arrow.

A laser 20 emits the beam of light 18 along an optical path towards the the dye donor 14 to heat the donor 14. Heating causes an image-wise transfer of dye from the dye donor 14 to the dye receiver 16 to thereby form a laser-induced thermal dye transfer image. The laser 20 is preferably a diode laser. Ordinarily, laser radiation from donor 14, receiver 16 and other optical components can be reflected back to the laser 20 and create intensity noise, but the donor 14 is not perpendicular to the incoming beam 18 so that light is not reflected back along the optical path.

Operation of the present invention is believed to be apparent from the foregoing description, but a few words will be added for emphasis. The problem of intensity noise can be reduced somewhat by coating the optical components with a nonreflective coating, but the reflection from the donor and receiver elements still remains a problem. With the present invention, the problem of intensity noise is solved by tilting the slide 12 at an angle so that any remaining specular reflections from the donor and receiver elements do not intercept the optical path to cause intensity noise. The slide is oriented at an angle to the incoming beam so that the beam is deflected in a direction not coincident with the incoming beam.

It can now be appreciated that there has been disclosed an apparatus and method for forming a laser-induced thermal dye transfer image. The method includes contacting a dye donor element with a dye receiving element and physically separating the dye donor and dye receiver by a finite distance using spacers while maintaining dye transferring proximity. The method includes image-wise heating the dye donor element by means of a laser and transferring a dye image to the dye receiving element to form a laser-induced thermal dye transfer image. The method also includes tilting the dye donor and thereby eliminating reflections back to the laser. Intensity noise in the laser caused by reflections from the donor film plane, called feedback noise, is eliminated by tilting the donor film plane and thereby eliminating reflections back to the laser cavity.

While the invention has been described with particular reference to the preferred embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

The present invention eliminates laser feedback noise without using expensive optical elements or suffering a loss of power. A simple solution is provided that requires tilting the image plane so that the reflected light is not coincident with the optical path and never makes it back to the laser. Because most of the optical elements are appropriately coated for anti-reflection, the major portion of specular reflection is from the donor film, and, by tilting the film platen, the specular reflection is eliminated.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

What is claimed is:

1. An apparatus for forming a laser-induced thermal dye transfer image comprising a beam of laser light projected along an optical path; a slide for bringing a dye donor element into dye transferring proximity to a dye receiver element; said dye donor element receiving said beam of laser light; and said slide being tilted by a slide tilting means to eliminate intensity noise caused by light reflecting from the dye donor element along the optical path.

2. An apparatus, as set forth in claim 1, wherein said slide is movable, relative to said beam of laser light, while tilted by said slide tilting means to scan the beam of light across the dye donor element in a page scan direction.

3. An apparatus for forming a laser-induced thermal dye transfer image, comprising:

slide means for bringing a dye donor element into a dye transferring proximity to a dye receiver element;

a laser emitting a beam of light toward said dye donor element to image-wise transfer dye from said dye donor element to said dye receiver element to form a laser-induced thermal dye transfer image; and means for tilting the slide means for eliminating intensity noise in the laser caused by light reflected from the dye donor element back toward the laser.

4. An apparatus, as set forth in claim 3, wherein said slide means is movable, relative to said beam of laser light, while tilted by the tilting means to scan the beam of laser light across the dye donor element in a page scan direction.

5. An apparatus, as set forth in claim 3, wherein said dye donor element and dye receiver element is in transfer proximity while spaced, by spacer beads interposed between said dye donor element and dye receiver element, from one another by a finite distance.

6. An apparatus, as set forth in claim 3, including spacer beads interposed between said dye donor element and dye receiver element to separate said donor element and receiver element by a finite distance.

7. An apparatus, as set forth in claim 3, wherein light emitted from said laser travels along an optical path to said dye donor element, and wherein said slide means is tilted so that specular reflections from the dye donor element do not intercept the optical path.

8. An apparatus, as set forth in claim 3, wherein light emitted from said laser travels along an optical path to said dye donor element and slide means, and wherein said slide means is tilted by said tilting means so that specular reflections from the dye donor element do not intercept the optical path.

9. A method for forming a laser-induced thermal dye transfer image, comprising the steps of:

bringing a dye donor element into dye transferring proximity to a dye receiver element by a slide means;

heating said dye donor element by a laser emitting a beam of light;

transferring dye from said. dye donor element to said dye receiver element and forming a laser-induced thermal dye transfer image; and tilting the slide means and eliminating intensity noise in the laser caused by light reflecting from the dye donor element back to the laser.

10. A method, as set forth in claim 9, further including the step of separating said dye donor element and dye receiver element by a finite distance.

11. A method, as set forth in claim 9, including the steps of:

emitting light from said laser along an optical path to said dye donor element; and tilting the slide means so that specular reflections from the dye donor element do not intercept the optical path.

12. A method, as set forth in claim 9, including the steps of:

emitting light from said laser along an optical path to said dye donor element; and tilting the slide means so that specular reflections from the dye donor element is not directed along the optical path toward the laser.

* * * * *